US011084683B1

(12) United States Patent
Shao

(10) Patent No.: US 11,084,683 B1
(45) Date of Patent: Aug. 10, 2021

(54) WINDING BAR FOR MANUFACTURING LIGHT STRING AND METHOD FOR MANUFACTURING LIGHT STRING

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 16/653,514

(22) Filed: Oct. 15, 2019

Related U.S. Application Data

(60) Provisional application No. 62/746,339, filed on Oct. 16, 2018.

(51) Int. Cl.
*F21V 19/00* (2006.01)
*B65H 57/14* (2006.01)
*F21S 4/10* (2016.01)

(52) U.S. Cl.
CPC ..... *B65H 57/14* (2013.01); *F21S 4/10* (2016.01); *F21V 19/0025* (2013.01); *B65H 2701/341* (2013.01)

(58) Field of Classification Search
CPC .... F21V 21/002; F21V 21/025; F21V 21/088; F21V 21/22; F21V 15/013; F21V 17/002; F21V 19/003; F21S 4/10; F21S 6/001; F21S 9/02
USPC ..... 362/219, 225, 249
See application file for complete search history.

(56) References Cited

U.S. PATENT DOCUMENTS 5,707,136 A * 1/1998 Byers ..... F21V 3/02 362/145
7,235,815 B2 6/2007 Wang
7,926,978 B2 4/2011 Tsai
8,371,716 B2 2/2013 Shen et al.
8,397,381 B2 3/2013 Tsai
8,721,113 B2 * 5/2014 Lai ..... F21K 9/69 362/217.02
9,175,836 B2 * 11/2015 Schatz ..... F21V 21/0816
10,205,073 B2 2/2019 Altamura
2003/0063463 A1 4/2003 Sloan et al.
2003/0103347 A1 * 6/2003 Friend ..... F21V 21/002 362/225
2005/0018424 A1 1/2005 Popovich
2006/0221609 A1 10/2006 Ryan, Jr.
2006/0277823 A1 * 12/2006 Barnett ..... F21V 21/088 47/33
2008/0094828 A1 4/2008 Shao
(Continued)

FOREIGN PATENT DOCUMENTS

CN 200982547 Y 11/2007
CN 201121811 Y 9/2008
(Continued)

*Primary Examiner* — Tung X Le
(74) *Attorney, Agent, or Firm* — Christensen, Fonder, Dardi & Herbert PLLC

(57) ABSTRACT

A winding bar for manufacturing a light string including a bar-shaped body. The bar-shaped body has a cross-section presenting a rectangular pattern or a polygonal pattern. The bar-shaped body includes a plurality of sides defining a plurality of lateral surfaces, and the bar-shaped body defines a work channel extending along a longitudinal direction. The work channel communicates with two ends of the bar-shaped body.

9 Claims, 17 Drawing Sheets

(56) References Cited

U.S. PATENT DOCUMENTS

| | | | | |
|---|---|---|---|---|
| 2009/0154156 | A1 | 6/2009 | Lo et al. | |
| 2010/0157598 | A1 | 6/2010 | Tsai | |
| 2011/0062875 | A1 | 3/2011 | Altamura | |
| 2011/0215368 | A1 | 9/2011 | Chen | |
| 2011/0228535 | A1 | 9/2011 | Shao | |
| 2011/0310601 | A1 | 12/2011 | Shao | |
| 2012/0039070 | A1 | 2/2012 | Shen et al. | |
| 2012/0275157 | A1 | 11/2012 | Hsu | |
| 2013/0058079 | A1* | 3/2013 | Dellian | F21V 29/70 362/217.14 |
| 2013/0107514 | A1 | 5/2013 | McNabb et al. | |
| 2014/0112001 | A1* | 4/2014 | Noh | F21V 23/005 362/311.01 |
| 2014/0268818 | A1 | 9/2014 | Huang et al. | |
| 2015/0117001 | A1 | 4/2015 | Fan | |
| 2016/0047516 | A1 | 2/2016 | Taylor | |
| 2016/0186940 | A1 | 6/2016 | Del Castillo et al. | |
| 2016/0341408 | A1 | 11/2016 | Altamura | |
| 2017/0023223 | A1 | 1/2017 | Tsai | |
| 2017/0038055 | A1 | 2/2017 | Daniels | |
| 2018/0058648 | A1* | 3/2018 | Fang | F21S 9/02 |
| 2018/0073708 | A1* | 3/2018 | Avery | F21V 21/22 |
| 2019/0277458 | A1 | 9/2019 | Shao | |
| 2019/0335559 | A1 | 10/2019 | Shao | |
| 2020/0236746 | A1 | 7/2020 | Shao | |

FOREIGN PATENT DOCUMENTS

| | | | |
|---|---|---|---|
| CN | 201898147 | U | 7/2011 |
| CN | 201966240 | U | 9/2011 |
| CN | 202613183 | U | 12/2012 |
| CN | 203703878 | U | 7/2014 |
| GB | 2 454 546 | A | 5/2009 |

* cited by examiner

WINDING BAR FOR MANUFACTURING LIGHT STRING AND METHOD FOR MANUFACTURING LIGHT STRING

PRIORITY CLAIM

This application claims the benefit of U.S. Provisional Patent Application No. 62/746,339, filed Oct. 16, 2018, which is incorporated herein in its entirety.

FIELD OF THE DISCLOSURE

The present disclosure relates to a method for manufacturing a light string, and more particularly to a winding bar for manufacturing a light string and a method for manufacturing the light string.

BACKGROUND

Known methods for manufacturing parallel-wire light strings are generally inefficient and prone to quality issues. Such known methods are described in U.S. Pat. No. 7,926,978, entitled Light Set with Surface Mounted Light Emitting Components, filed Dec. 18, 2008. Such methods described in U.S. Pat. No. 7,926,978, and other methods of manufacturing light strings are not suitable for manufacturing high-volumes of light strings with many light-emitting diodes.

SUMMARY

For manufacturing string-type electrical devices, such as a light string, it would be better to continuously deliver a wire moving through a production area to mount light sources without cutting the wire and then collecting the light string with a reel. This would be followed by cutting the long continuous light string into a plurality of short light strings having required lengths and with a number of light sources.

Known methods include delivering an individual wire section to be processed to a work station. Then one or more manufacturing procedures are performed. To ensure that each procedure is performed adequately, the wire is delivered slowly and each work station performs the manufacturing procedures to one section at once, such that it is difficult to increase productivity. Currently, the only reliable way to increase productivity with such a method is to establish more production lines. However, establishing more production lines means more capital investment, and more production lines at times would potentially increase the idleness ratio of the production lines.

In contrast, to increase productivity for manufacturing light strings, the present disclosure provides a winding bar for manufacturing a light string and a method for manufacturing the light string using the winding bar, so as to increase productivity.

A winding bar according to at least one embodiment comprises a bar-shaped body. The bar-shaped body has a cross-section that presents a rectangular pattern or a polygonal pattern, such that the bar-shaped body includes a plurality of lateral surfaces of the sides of the body, the bar-shaped body includes a work channel, trench, or recess extending along a longitudinal direction of the bar-shaped body. The work channel communicates with two ends of the bar-shaped body. In an embodiment, the work channel is defined by an opening of one of a plurality of sides of the bar-shaped body, or by the absence of a side, or in other words, is defined by three sides of the bar-shaped body.

In one or more embodiments, the winding bar further comprises a shaping bar set in the work channel and coupled to the winding bar. In an embodiment, the shaping bar includes a shaping portion projecting outside the work channel.

In one or more embodiments, the bar-shaped body includes guiding grooves on inner walls of the work channel and in parallel to the work channel; and the shaping bar further includes guided portions slidably assembled to the guiding grooves.

In one or more embodiments, the winding bar further comprises a cooling passage in the bar-shaped body.

A method for manufacturing the light string according to one or more embodiments of using the above-mentioned winding bar comprises the steps of: stripping off an insulation layer of a portion of a wire, the working area of the wire, to expose a plurality of work areas of the wire that comprise exposed conductors of the wire; winding the wire over the winding bar in a spiral manner, wherein each of the work areas with exposed conductors is located over the work channel of the bar-shaped body; soldering a plurality light sources onto the plurality of exposed conductors of the wire work areas; and feeding glue onto each of the light sources over the work channel in a batch manner, so as to wrap each of the light sources with the glue.

In one or more embodiments, the method further comprises a step for trimming the wire before the winding procedure.

In one or more embodiments, the step for soldering the plurality of light sources onto the plurality of exposed conductors of the work areas comprises: temporarily attaching leads of the light sources onto the exposed conductors of the work areas having solder paste; and simultaneously heating the solder paste on the work areas to solder the plurality of light sources onto the work areas.

In one or more embodiments, the method further comprises a step for extracting a piece of a light string having a predetermined length from the winding bar and cutting off the light string after feeding glue onto each of the light sources over the work channel in a batch manner, so as to obtain the light string having a predetermined length and a predetermined number of light sources.

In one or more embodiments, the method further comprises a step for forming a plurality of cut-off points of the wire over the bar-shaped body using a cutting tool after feeding glue onto each of the light sources over the work channel in a batch manner, so as to have the light string over the bar-shaped body directly become a plurality of pieces of light strings, each having a predetermined length and a predetermined number of light sources.

In one or more embodiments, the step for feeding glue onto each of the light sources over the work channel in a batch manner further comprises attaching a plurality of light caps on the light sources in a batch manner using a cap holder.

By using the winding bar of the present disclosure, each procedure for manufacturing the light string is simultaneously performed to a plurality of light sources in a batch manner, which is different from manufacturing methods known in the art, i.e., performing wire stripping, light source soldering, feeding glue for only one light source at once, therefore, the method for manufacturing the light string of the present disclosure increases productivity significantly.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

DETAILED DESCRIPTION

Figure 1:
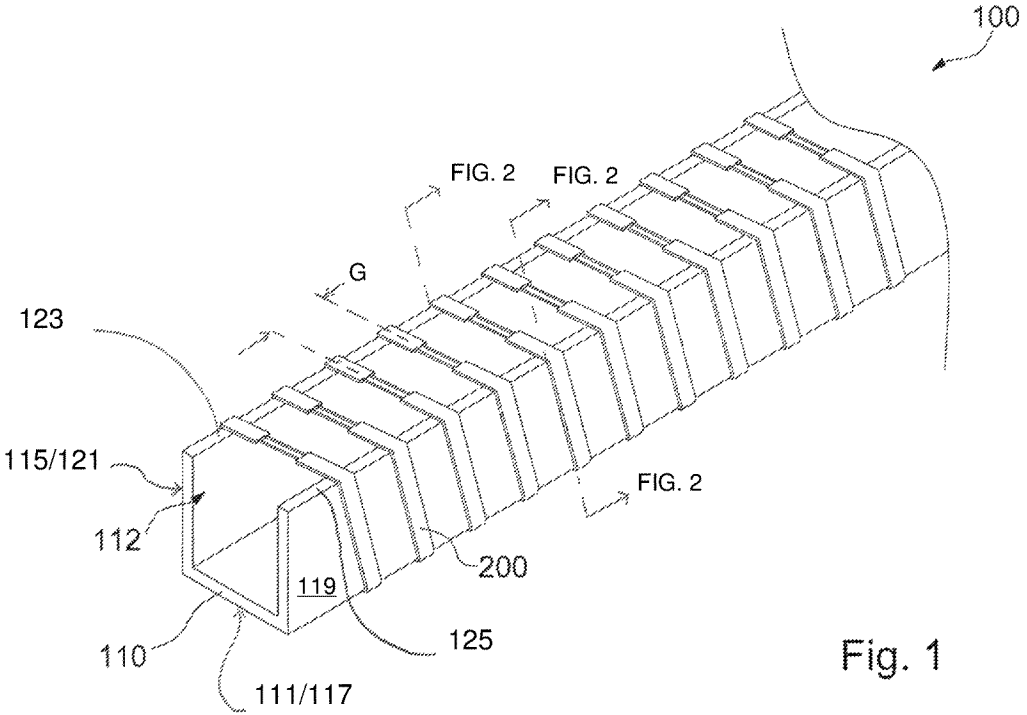
FIG. 1 is a perspective view of a winding bar according to an embodiment of the present disclosure.
Figure 2:
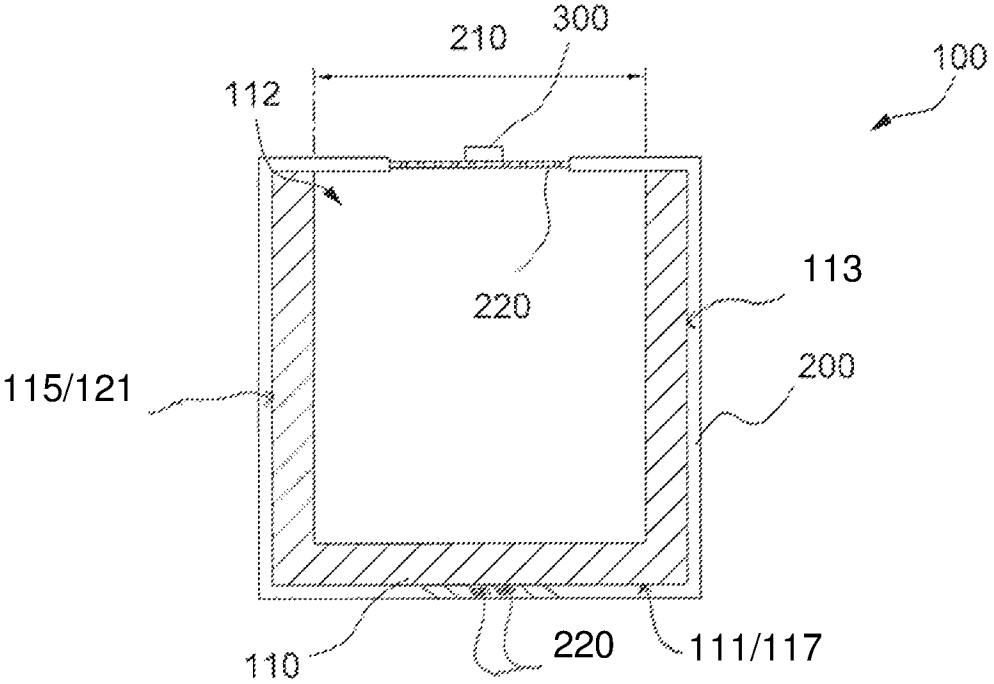
FIG. 2 is a cross-sectional view of the winding bar according to FIG. 1, with an LED.

Referring to FIG. 1 and FIG. 2, a winding bar 100 according to an embodiment of the present disclosure is used to manufacture a light string 200.

As shown in FIG. 1 and FIG. 2 (cross section of FIG. 1 with LED added), the winding bar 100 comprises a bar-shaped body 110. In an embodiment, the bar-shaped body 110 in cross-section presents a rectangular shape or pattern or a polygonal pattern, such that the bar-shaped body 110 includes a plurality of sides, including bottom side 111, first side 113, and second side 115. Sides 111, 113 and 115 define lateral or side surfaces 117, 119, 121, 123 and 125, as depicted. In an embodiment not depicted, sides 111, 113 and 115 their lateral or side surfaces 117, 119, 121, 123 and 125 may define a series of grooves or channels that receive and secure the wire on the sides of the winding bar and bar-shaped body 110.

In other embodiments, the bar-shaped body 110 presents other shapes, such as a circular or oval shape.

The bar-shaped body 110 defines a recess, groove, trench, channel or work channel 112 extending along a longitudinal direction or axis of the bar-shaped body 110. In an embodiment, and as depicted, the work channel 112 communicates with two ends of the bar-shaped body 110, such that the two ends of the bar-shaped body 110 are open. In an embodiment, the work channel 112 is defined by a bottom side 111, a first side 113 and a second side 115. In an embodiment, not depicted, portions of a top side of bar-shaped body 110 extend radially over channel 112, forming a slot extending parallel to work channel 112.

As shown in FIG. 1, the bar-shaped body 110 of the winding bar 100 is provided for winding the wire 200 thereon in a spiral manner, with the winding of the spiraled wire 200 having a constant pitch. The work areas 210 of the wire 200 to be processed are positioned over the work channel 112, such that a "work area" may be defined as the area of the wire that is being "worked on," which in an embodiment is an area of the wire positioned over the work channel 112. A wire stripping procedure is performed on the work areas 210 to expose the metal cores or conductors 220 of the wire 200 over the work channel 112. The following procedures, soldering the light sources, feeding glue, and attaching the light caps 310, are performed on the exposed part of the metal core 220.

In an embodiment, the peripheral length, or circumference of the bar-shaped body 110, including the three sides 111, 113, 115 and the top distance between side walls 113 and 115, is approximately equal to the gap between two light sources 300 on the wire 200 (light string). If the bar-shaped body 110 has a plurality of work channels 112 (defined by different sides of the bar-shaped body 110 or by the different lateral surfaces of the sides), the gap is determined by the work channel 112 that is used to process the work areas 210. That is, a bar-shaped body 110 having plurality of work channels 112 can be adopted to form different gaps between light sources 300.

The wire 200 is wound around the bar-shaped body 110 in a spiral manner, such that it is easy to arrange the work areas 200 to be separated by a constant gap G over the work channel 112. The work areas 200 with constant gap G over the work channel 112 can be processed in a batch manner. That is, soldering the light sources, feeding glue, or attaching the light caps 310, can be performed in a batch manner instead of processing the light sources 300 one by one.

Figure 3:
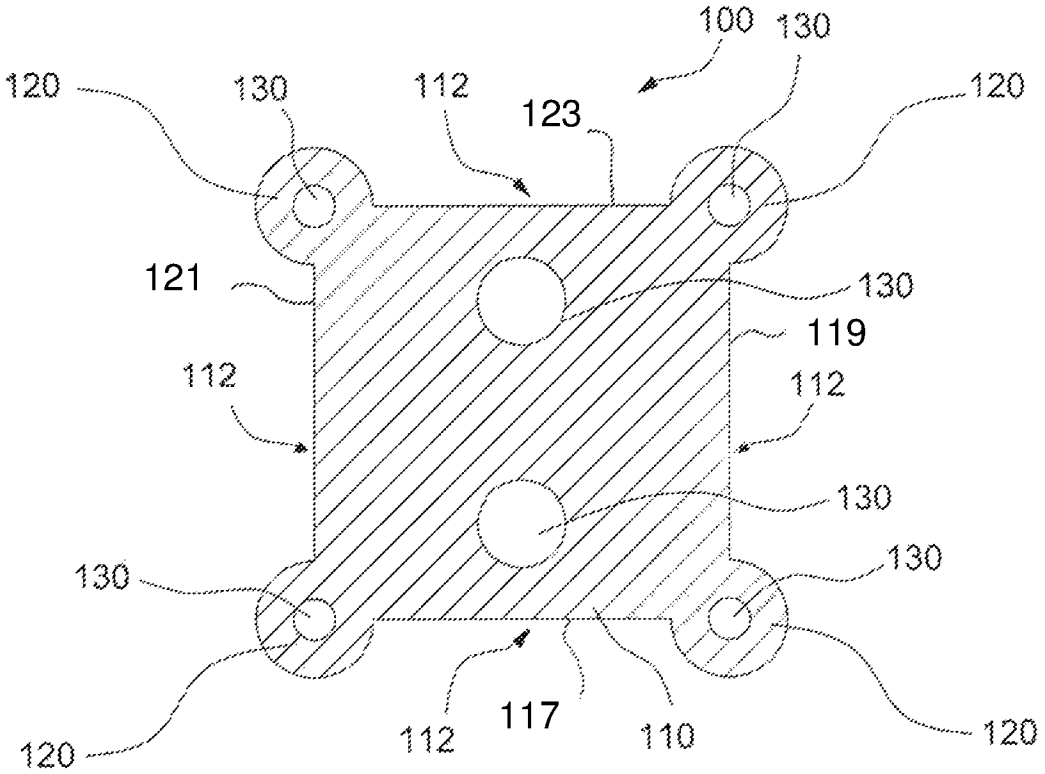
FIG. 3 is a cross-sectional view of a winding bar according to another embodiment of the present disclosure.

As depicted in FIG. 3, another embodiment of a winding bar 100 is depicted in cross section. In this embodiment, the junction between two adjacent lateral surfaces occurs at a column 120, which is directly formed at the junction or attached to the junction. The column 120 extends in parallel to the bar-shaped body 110. The columns 120 are used to cover sharp ridges between adjacent lateral surfaces 117, 119, 121 and 123. Meanwhile, the columns 120 protrude over the lateral surfaces, that is, on any one lateral surface, the columns 120 on two edges protrude upward, so as to define a work channel 112 between the two columns 120. As a result, at each lateral surface of the bar-shaped body 110, a work channel 112 is defined by two columns 120, such that bar-shaped body 110 comprises multiple, in this case four, work channels. In a winding procedure, if a small gap between two light sources 300 is required, multiple work channels can be used, for example, each of the four work channels can be used such that a work area 210 is in each work channel 112; if a large gap between two light sources 300 is adopted, the work areas 210 can be arranged to lay over less than all of the work channels 112, such as one or two of the work channels 112. That is, a bar-shaped body 110 having a plurality of work channels 112 can be adopted to create different-sized gaps between two light sources 300.

Furthermore, in at least one embodiment, the winding bar 100 further comprises cooling passages 130 within the bar-shaped body 110 and the columns 120. The cooling passages 130 are provided to circulate coolant to cool the wire 200 and the light sources 300 if cooling is required during manufacturing. For example, when laser or other heating means is used for wire stripping, or hot air flow is used for welding, appropriate cooling is usually required.

Figure 4:
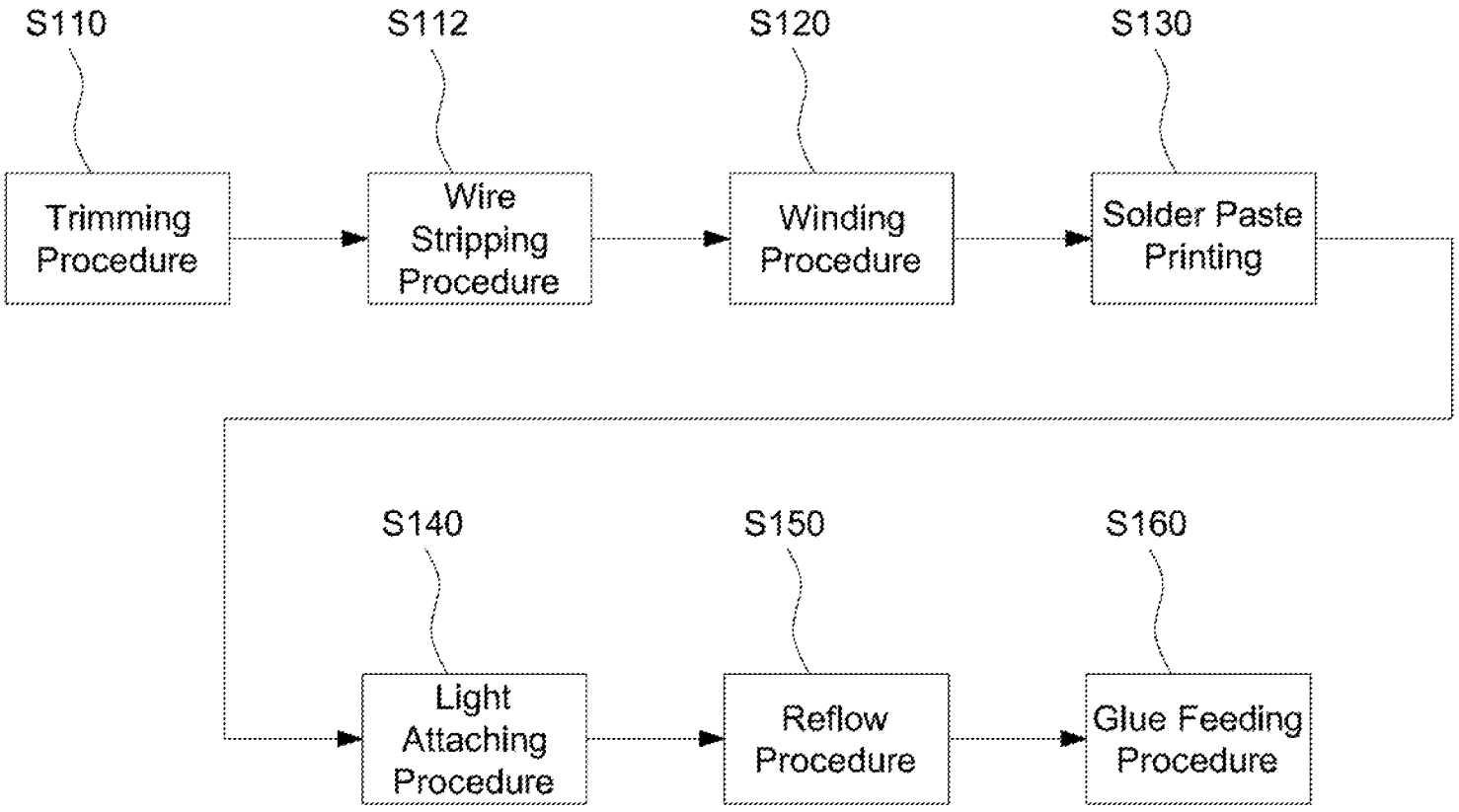
FIG. 4 is a flowchart of a method for manufacturing a light string of the present disclosure.

Referring to FIG. 4, a method for manufacturing the light string is shown, the above-mentioned winding bar 100 is used in this method. The method comprises the following steps.

Figure 5:
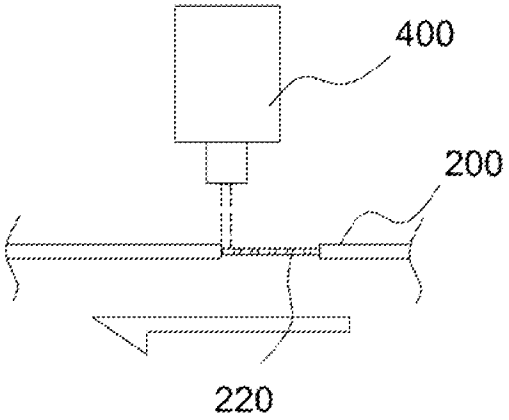
FIG. 5 is a lateral view of a wire according to an embodiment of the present disclosure depicting a wire-stripping procedure.

First, a trimming procedure and a wire stripping procedure are performed on the wire 200, as shown in step S110 and step S112. The trimming procedure is to eliminate distortion and reversion of the wire 200, and ensure the metal cores 220 of the wire 200 are arranged in parallel instead of being stranded. The wire stripping procedure is for stripping the work areas 210 over the work channel 112, so as to strip off the insulation layer, such as plastic layer or insulation paint, of the wire 200 and expose the metal core 220 of the wire 200 on the work channel 112. Any number of stripping methods can be used to perform the wire stripping procedure, for example, using a laser to burn out the insulation layer, using a stripping tooling, etc. Taking laser stripping as an example, as shown in FIG. 5, the wire 200 is continuously moved in a direction indicated under the laser head 400 or the other type of stripping tool, and the wire stripping procedure is continuously performed on the wire 200, so as to strip portions of insulation from wire 220, exposing metal cores 220.

Figure 6:
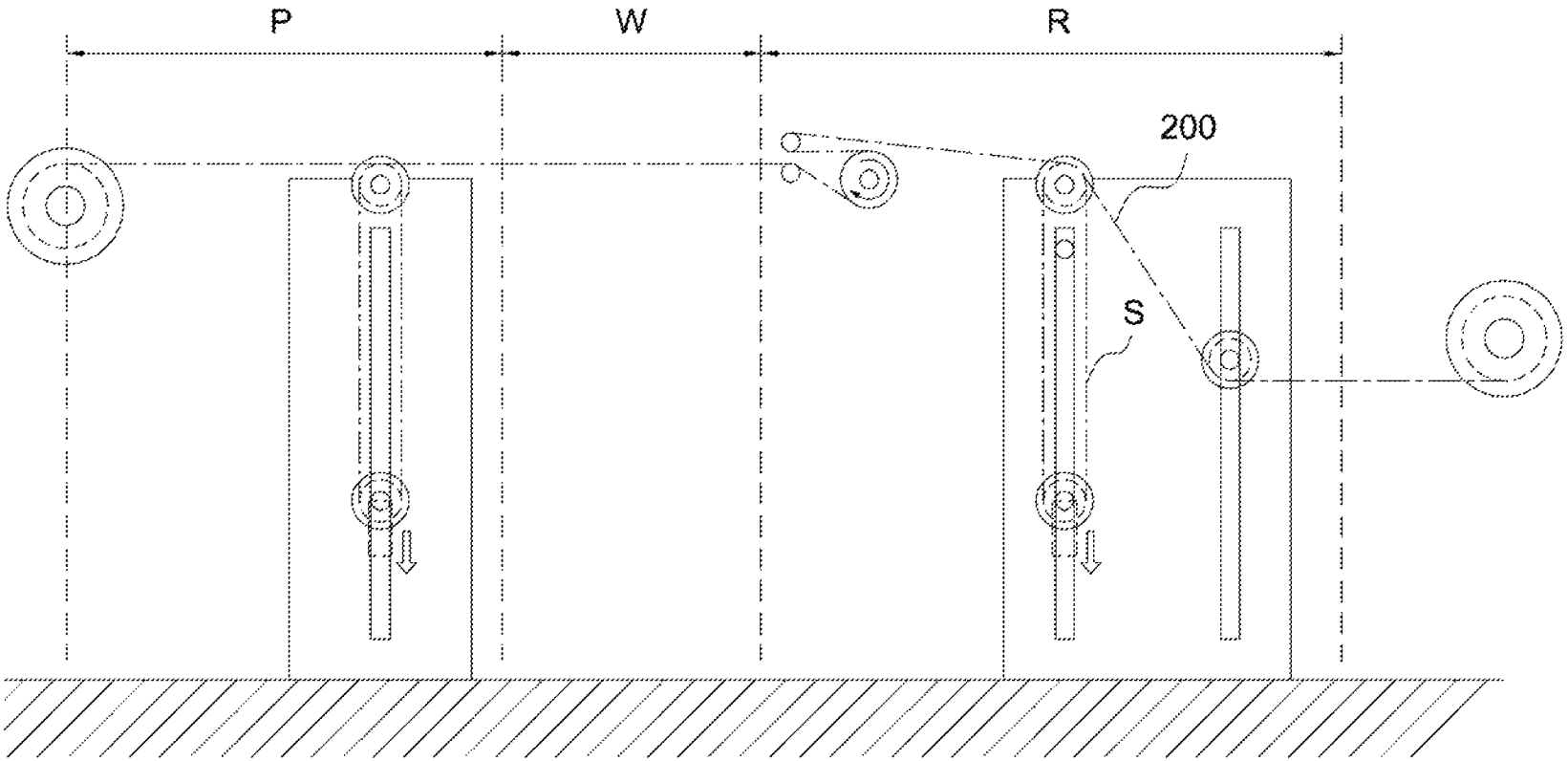
FIG. 6 is production line for performing a trimming procedure and a wire-stripping procedure according to an embodiment of the present disclosure.

FIG. 6 shows a production line for the trimming procedure and the wire stripping procedure. Wheels are disposed in the trimming area R of the forepart of the production line to trim the wire 200 and place wire 200 under tension with a uniform load. The stripping area W is provided to dispose the laser head 400 or the other type of stripping tool as shown in FIG. 5 to continuously strip the wire 200. Finally the wire 200 is withdrawn in the finishing area P. On the right side of the finishing area P, a withdrawal wheel is provided to withdraw the wire 200. Alternatively, the winding bar 100 can be used to withdraw the wire 200 so as to perform the winding procedure simultaneously by winding the wire 200 over the winding bar 100.

Referring FIG. 4, then the winding procedure is performed, as shown in step S120. The wire 200 is wound over the winding bar 100 in a spiral manner with the plural work areas 210 located over the work channel 112 of the bar-shaped body 100, and such that there is a uniform or constant gap between each two adjacent light sources 300.

Figure 8:
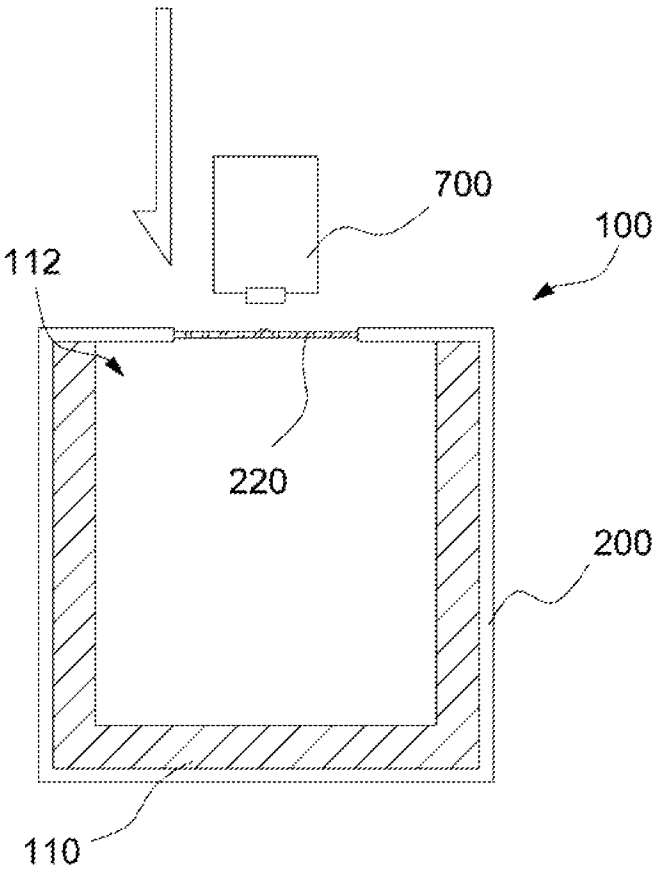
FIG. 8 is a cross-sectional view of a winding bar according to an embodiment of the present disclosure, depicting a procedure for attaching the light sources.
Figure 7:
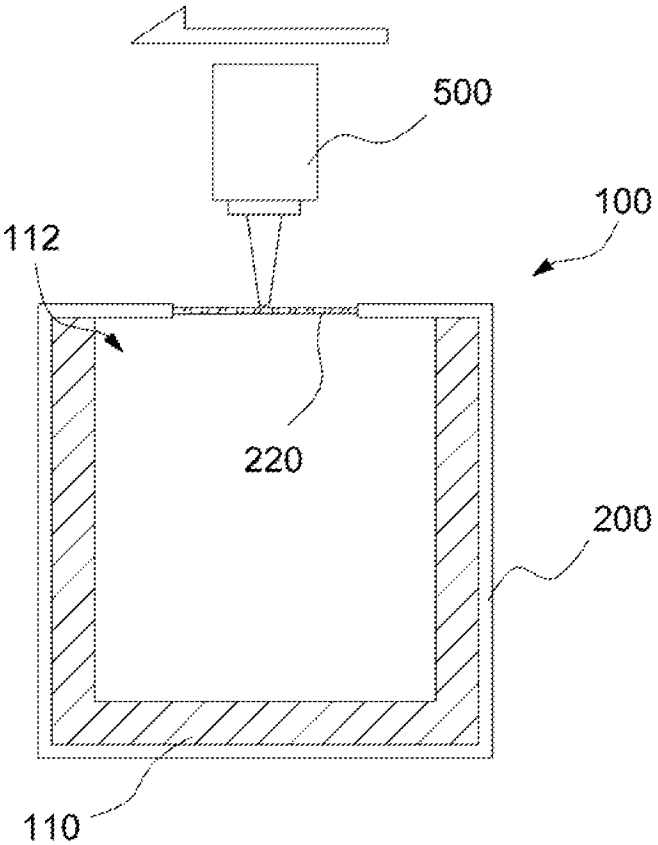
FIG. 7 is a cross-sectional view of a winding bar according to an embodiment of the present disclosure, depicting solder paste printing.

As depicted in FIG. 4, FIG. 7 and FIG. 8, the soldering procedure is performed to solder the plurality of light sources 300 onto the plurality of work areas 210.

Step S130 is a solder paste printing step. Solder paste printing equipment 500 is used to print the solder paste on the work areas 210 in a batch manner. The work areas 210 are located over the work channel 112 and arranged in a straight line; such that the solder paste printing equipment 500 can perform solder paste printing on the plurality of work areas 210 simultaneously.

Step S140 is a light attaching procedure for temporarily attaching leads of the light sources 300 onto the work areas 210 having the solder paste. Similarly, the light sources 300 are initially fixed or held by a light holder 700, such that the light sources 300 are arranged in a straight line. Next, the light holder 700 is used to position and attach the light sources 300 onto the work areas 210 having the solder paste, then the light sources 300 are released by the light holder, and thereby temporarily positioned on the wire. An example of the light source 300 is a light emitting device (LED), though other types of small-sized light sources are not excluded in the present disclosure. In an embodiment wherein light source 300 comprises an LED, the LED may be a surface mount LED with surface mounts leads, such as an anode and a cathode. In an embodiment, the LED is mounted to a top portion of the conductors, such that the LED is facing upwards and projecting light radially with respect to work channel 112. In an embodiment, the LED is placed in between the conductors.

The work area 210 having one light source 300 attached thereon is an illustration, in at least one embodiment, each of the work areas 210 has a plurality light sources 300 disposed thereon. The wire 200 having two metal cores 220 is also an illustration. The number of the metal cores 220 is determined by the circuit design of the light string, in at least one embodiment, the wire 200 has three or more metal cores 220.

Step S150 is a reflow procedure, in reflow procedure, the solder paste on the work areas 210 are heated in a batch manner, so as to solder the plurality of light sources 300 onto the work areas 210. Similarly, coolant is circulated in the cooling passages 130 of the winding bar 100, so as to prevent the wire 200 from being overheated to a point of deterioration.

Figure 9:
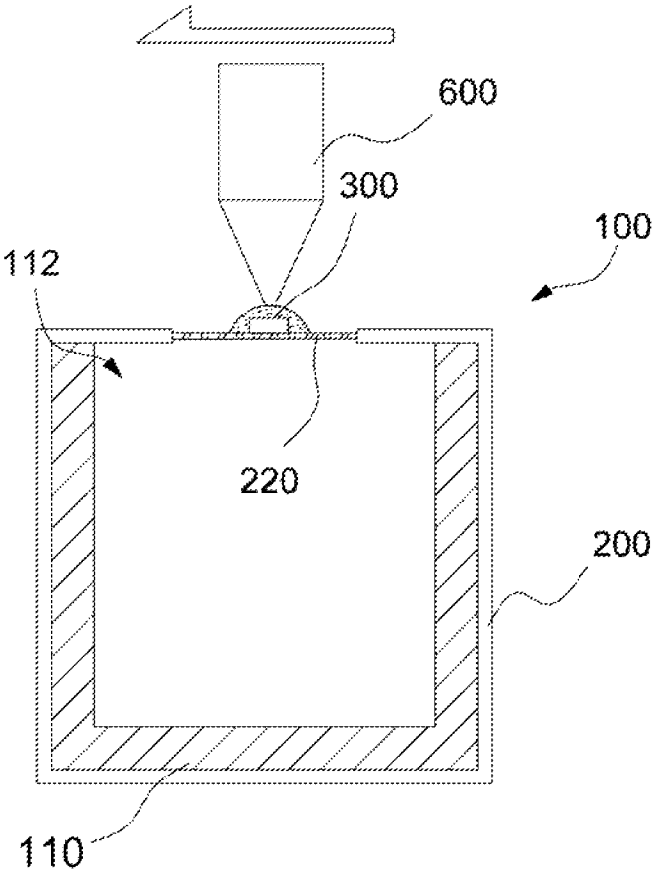
FIG. 9 is a cross-sectional view of a winding bar according to the embodiment of the present disclosure, depicting a glue-feeding procedure.

As shown in FIG. 5 and FIG. 9, step S160 is the glue feeding procedure for feeding glue onto each of the light sources 300 over the work channel 112, in a batch manner, so as to wrap each of the light sources 300 with transparent or translucent glue. In an embodiment, the glue-feeding tool 600 has a plurality of feeding holes, each feeding hole feeds glue onto one of the light sources 300 so as to perform glue feeding procedure on the plurality of light sources 300 simultaneously, and thereby complete the light string basic manufacture.

Figure 10:
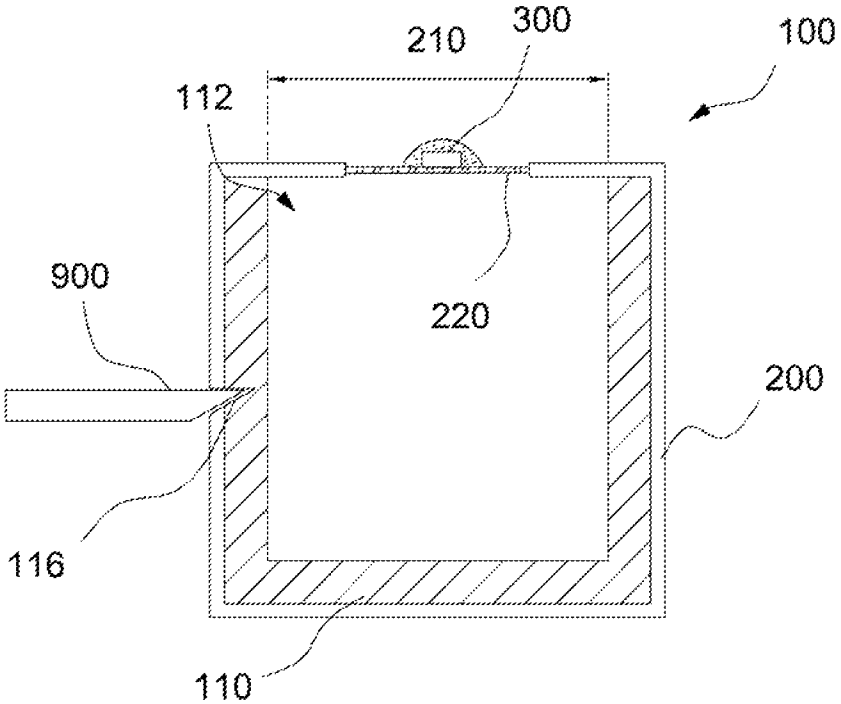
FIG. 10 is a cross-sectional view of a winding bar according to an embodiment of the present disclosure, depicting a finishing procedure.

As shown in FIG. 10, in one embodiment, the finishing procedure is to the manufactured string of lights into a plurality of shorter light strings having a predetermined length and number of light sources. The wire 200 is cut at a plurality of cut-off points of the wire 200 at the bar-shaped body 110 with a cutting tool 900, so as to have the light string wrapped over the bar-shaped body 110 directly become plural pieces of light strings, each having a predetermined length and a predetermined number of light sources, and then withdraw the plural pieces of light strings. In this cutting procedure, bar-shaped body 110 may have a positioning groove 116 corresponding to the cutting edge of the cutting tool 900 to ensure that the cutting edge is able to cut completely through the wire 200.

Figure 11:
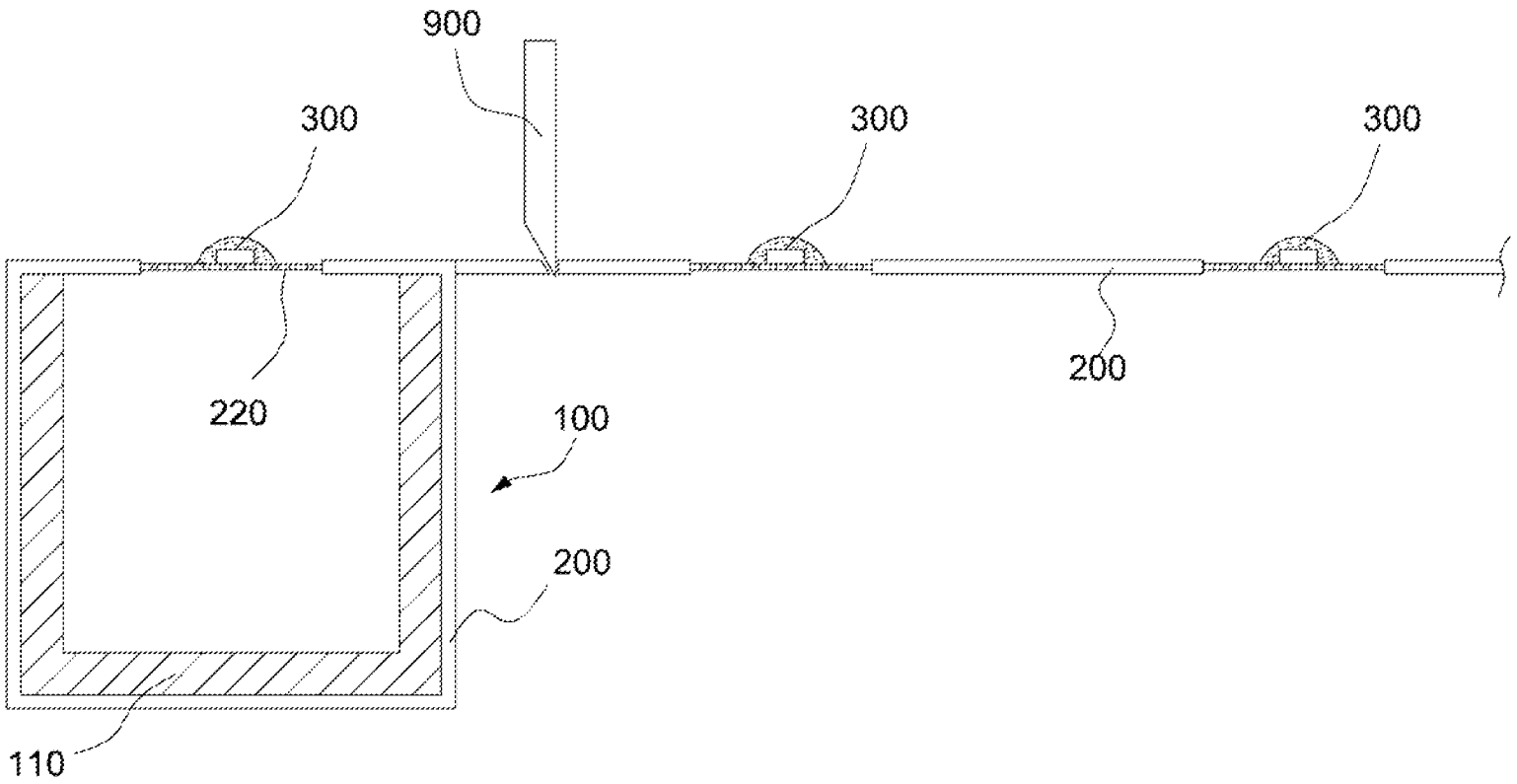
FIG. 11 is a cross-sectional view of a winding bar according to an embodiment of the present disclosure, depicting another finishing procedure.

As shown in FIG. 11, another approach for the finishing procedure is to extract a piece of a light string having a predetermined length from the winding bar 100 and then cut off the light string by the cutting tool 900, so as to obtain the light string having the predetermined length and a predetermined number of light sources 300.

Other procedures may be added in to the procedures as shown in FIG. 4 for processing the wire 200 or the light string.

Figure 13:
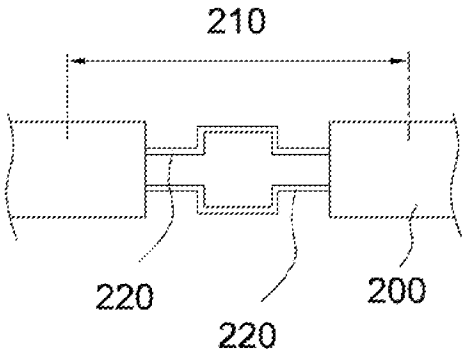
FIG. 12 and FIG. 13 are a lateral view and a top view of a wire according to an embodiment of the present disclosure, depicting performing a stamping procedure on the work areas, which includes exposing wire conductors.
Figure 12:
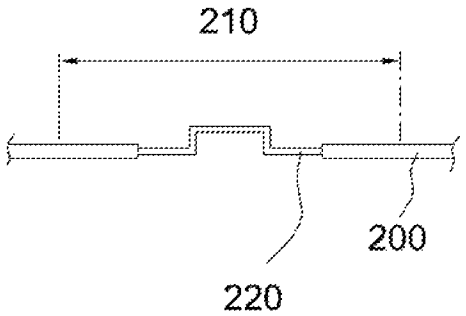

As shown in FIG. 12 and FIG. 13, after the wire-stripping procedure in step S120, a stamping procedure is performed on the stripped conductors of the work areas 210 in the stripping area W to shape the conductors of the work areas 210. A planar area is formed on the shaped work area 210 and the distance between the metal cores 220 is adjusted to match the distance between the leads of the light source 300. FIG. 11 shows a planar area is formed on metal cores 220 in the work area 210. FIG. 12 shows in the planar area the distance between the metal cores 220 is adjusted to match the distance of the leads of the light source 300.

In an embodiment, light sources 300 are placed atop the conductors 220, atop the planar area. In another embodiment, light sources 300 are placed in between conductors 220, such that leads on the sides of light sources 300 are in contact with the conductors 220.

Figure 14:
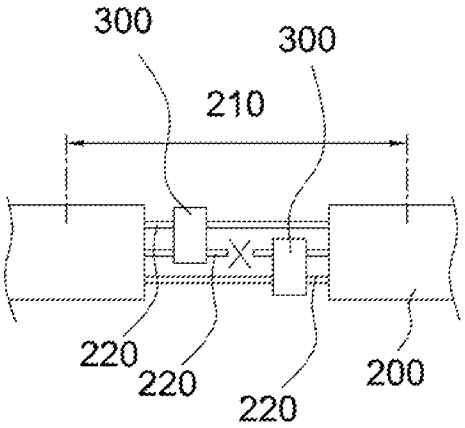
FIG. 14 is a top view of a wire according to an embodiment of the present disclosure, depicting cutting off the metal core of the wire.

As shown in FIG. 14, a cutting-off procedure can be performed before the glue feeding procedure of step S150 to cut at least one of the metal cores 220. As shown in FIG. 13, in a wire 200 having three metal cores 200, each work area 210 has two light sources 300 welded thereon, and the two light sources 300 are connected to different pair of metal cores 220. Before the glue feeding procedure, one of the two metal cores 220 is cut to have the two light sources 300 electrically connected in series. In an embodiment, a metal core 220 is simply cut, and since the wire is under tension during manufacture, including cutting, the ends of the wire adjacent the cut area move apart to break continuity of the cut portions of the metal core. In another embodiment, a portion of the metal core 220 is removed by cutting so as to create a gap between ends of the metal core.

Figure 16:
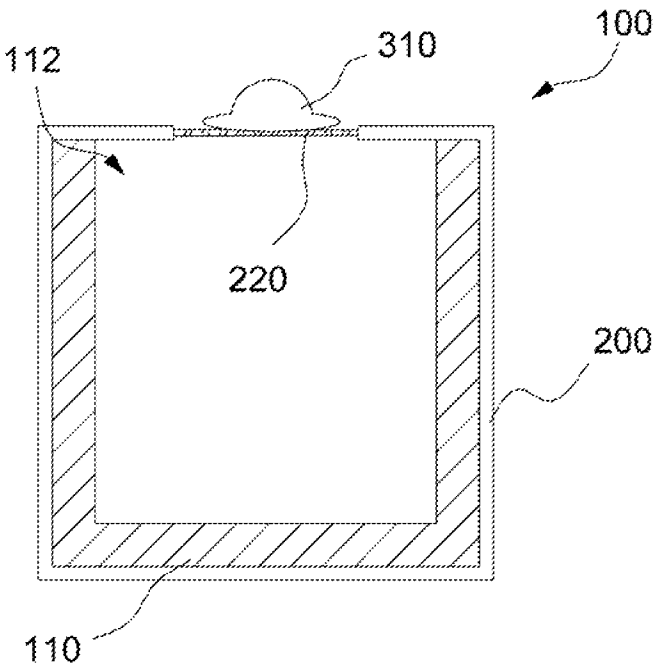
FIG. 15 and FIG. 16 are cross-sectional views according to an embodiment of the present disclosure, depicting a procedure for attaching a light cap onto the light source.
Figure 15:
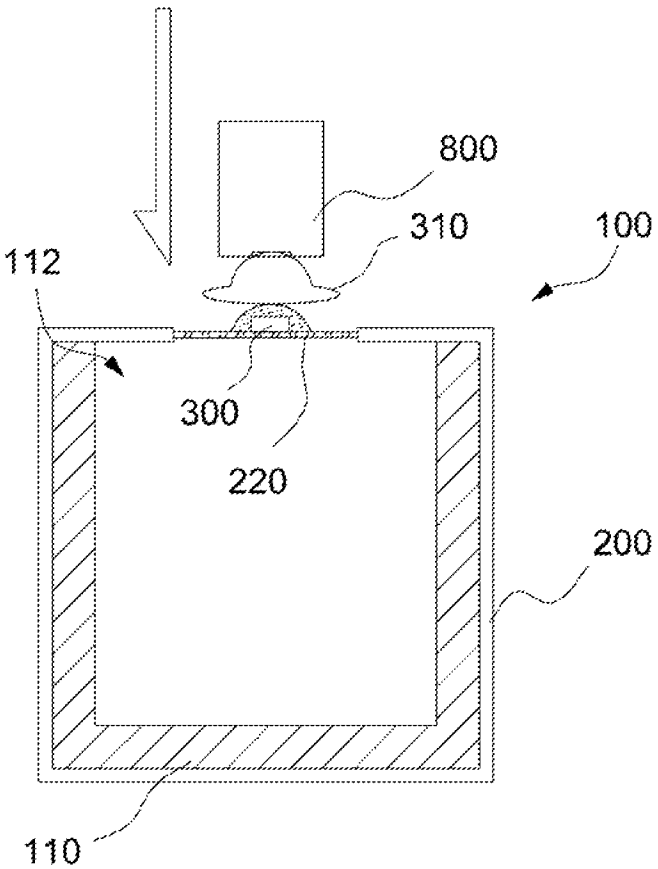

As shown in FIG. 15 and FIG. 16, a holder like that used in the light-attaching procedure can be used to assemble the other component in a batch manner. After the glue feeding procedure, the glue can be used to fix light covers or caps 310 onto the light sources 300. Similarly, the light caps 310 are held by a cap holder 800 at first, such that the light caps 310 are arranged in a straight line. Next, the cap holder 800 is used to attach the light caps 310 onto the light sources 300 having the glue covered thereon, and then the light caps 310 are released. After the glue is solidified, the glue fixes the light caps 310 on the light sources 300. In an embodiment, the glue is a UV-curable glue; after the light caps 310 are attached on the light sources 300, the glue can be rapidly solidified by UV curing, so as to shorten the time required to manufacture the light string.

Figure 17:
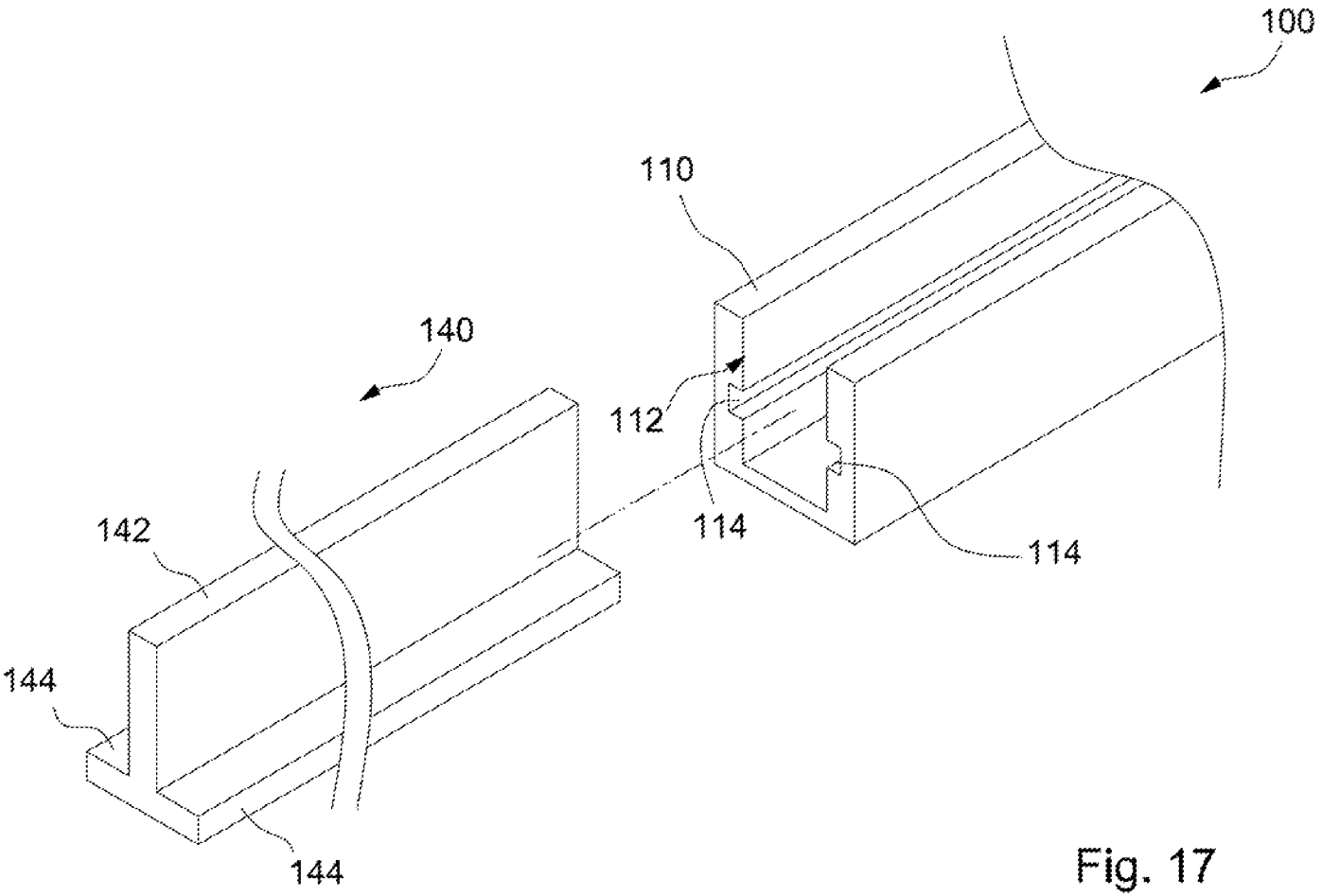
FIG. 17 is a perspective view of a winding bar according to yet another embodiment of the present disclosure.
Figure 18:
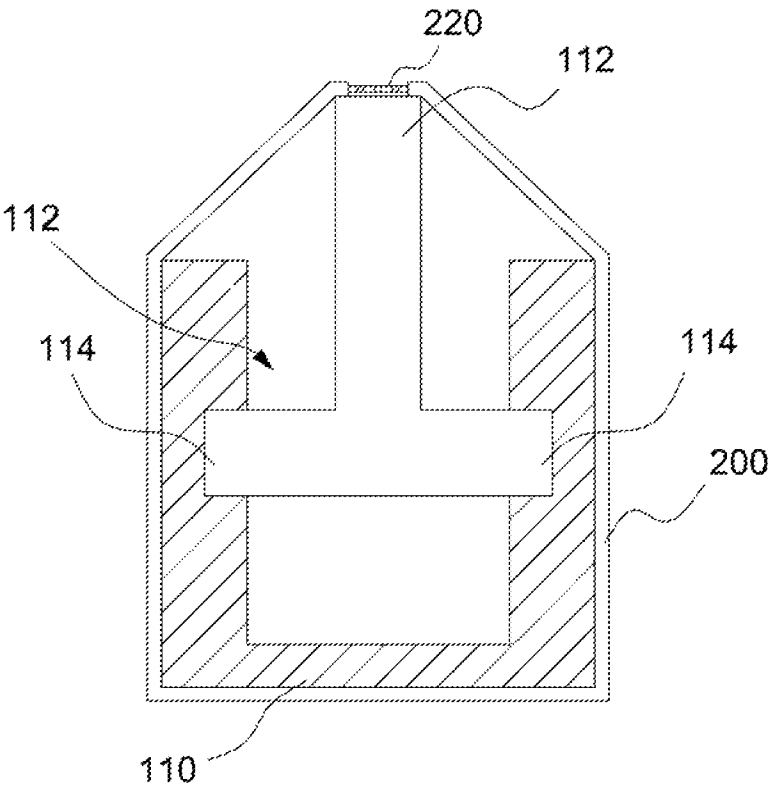
FIG. 18 is a cross-sectional view of a winding bar according to the yet another embodiment of the present disclosure.

As shown in FIG. 17 and FIG. 18, the procedure for shaping the work areas 210 can be performed on the winding bar after the winding procedure. In this embodiment, the winding bar 100 is modified. The winding bar 100 in FIG. 17 comprises a bar-shaped body 110 and shaping bar 140. The bar-shaped body 110 further comprises guiding groove 114 in the inner side walls of the work channel 112 that extend in parallel to the work channel 112. The shaping bar 140 includes a shaping portion 142 and two guiding portions 144. The two guiding portions are slidably assembled to the guiding grooves 114, so as to fix the shaping bar 140 in the work channel 112 with the shaping portion projecting outside the work channel 112.

Figure 19:
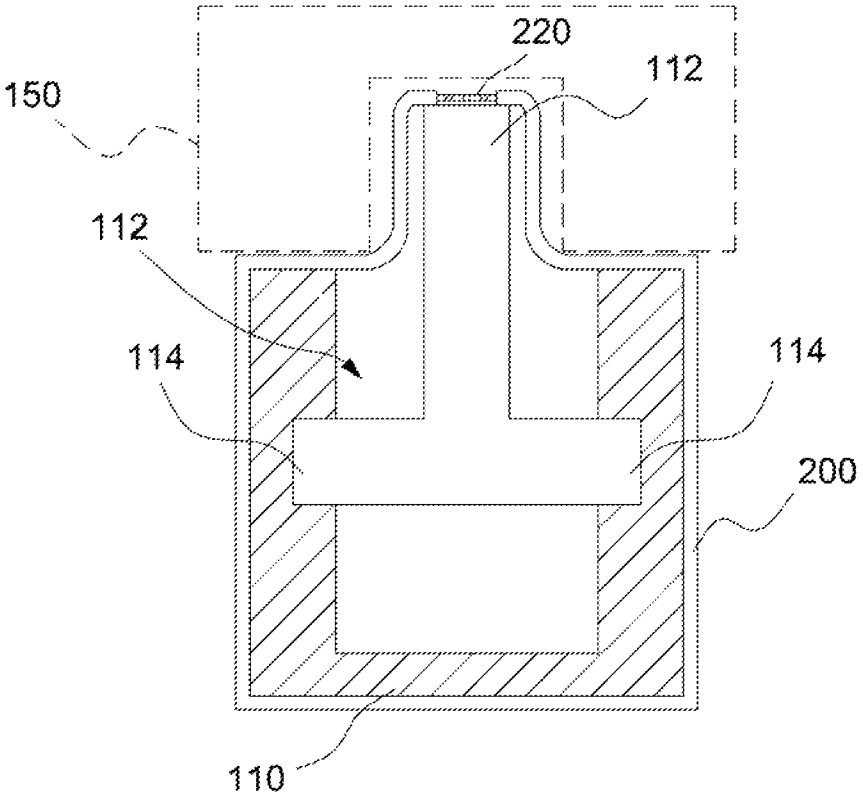
FIG. 19 is a cross-sectional view of a winding bar according to the yet another embodiment of the present disclosure, depicting performing a trimming procedure by using a stamping tool.

As shown in FIG. 19, by stamping the work area 220 on the shaping portion 142 using pressing tool 150, the work area 220 and part of the wire 200 form a U-shaped section. Next, the shaping bar 140 can be removed from one of the two ends of the bar-shaped body 110.

Figure 20:
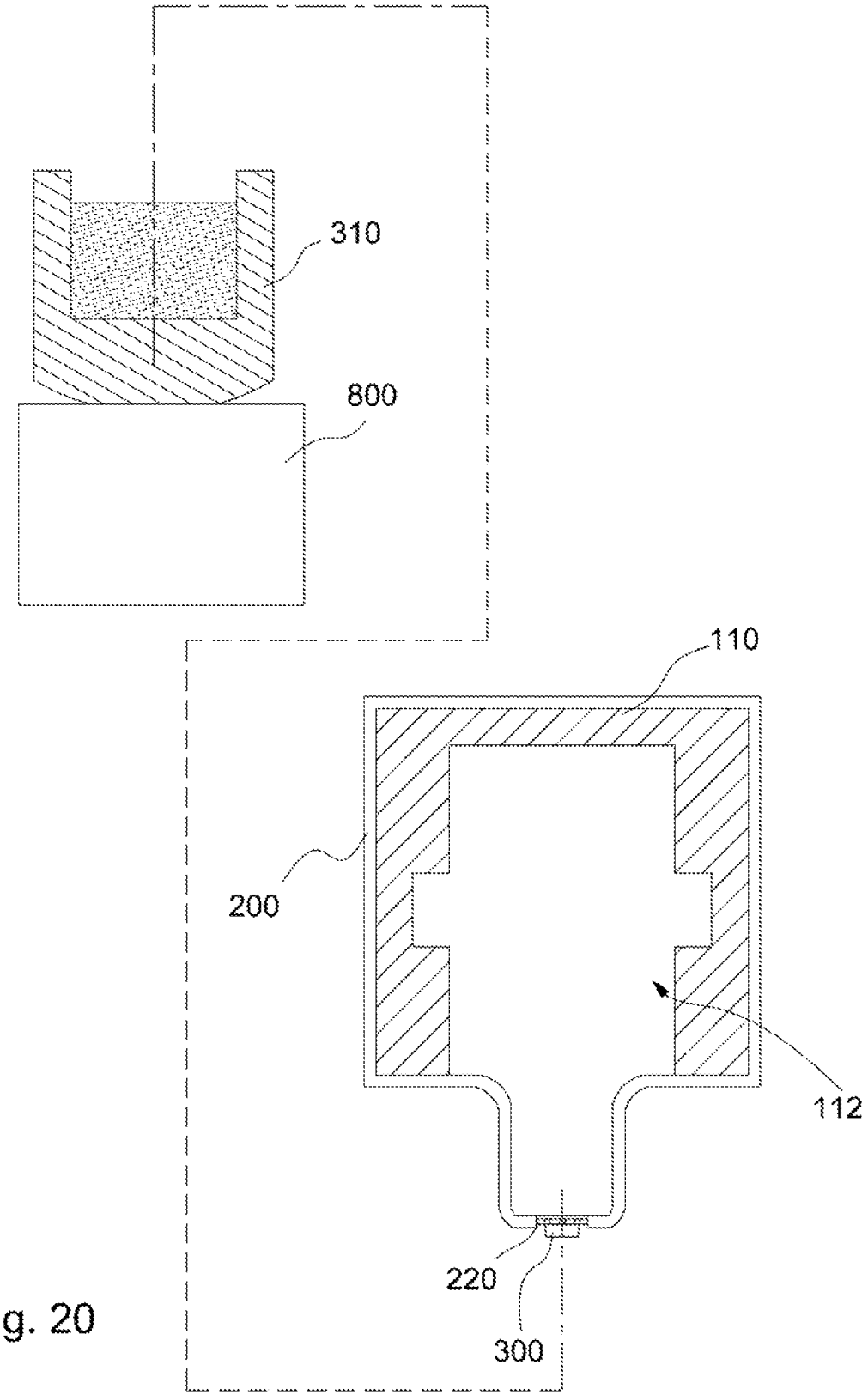
FIG. 20 is a cross-sectional view of a winding bar according to the yet another embodiment of the present disclosure, depicting feeding glue into the light cap.

As shown in FIG. 20, in an alternate version of the glue feeding procedure S160, glue is applied to the modified U-shaped section. The cap holder 800 is used to hold the light caps 310. In this example, the interior space of each light cap 310 is configured to receive the U-shaped work area 210. Initially, the light cap 310 is placed upside down with the opening facing upward, and the feeding glue tool 600 feeds glue into the interior space of the light cap 310 through the opening.

Figure 21:
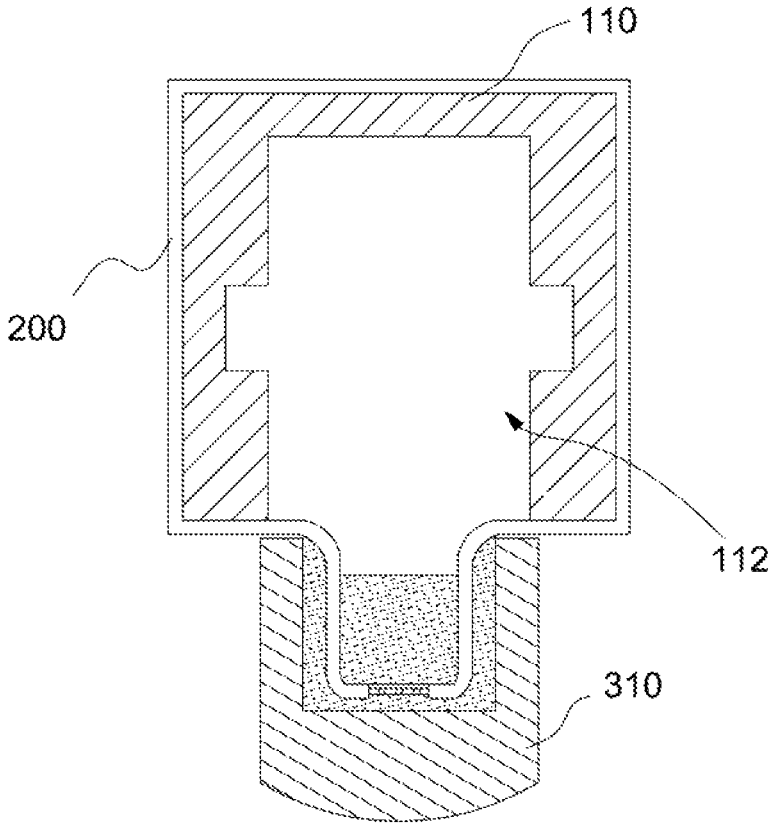
FIG. 21 is a cross-sectional view of a winding bar according to the yet another embodiment of the present disclosure, showing the procedure of attaching a light cap onto the light source.

As shown in FIG. 21, the winding bar 100 is also placed upside down (rotated 90 degree about the longitudinal axis), such that the light source 300 and the work area 210 both face downward. Next, the light source 300 and the work area 210 are inserted into the interior space of the light cap 310, and the light source 300 and the U-shaped section of the wire 200 are covered by the glue in the interior space. In an embodiment, the glue is a UV-curable glue; after the light source 300 and the work area 210 are inserted into the interior space, the glue is rapidly solidified by UV curing to fix the light cap 310 on the light source 300, so as to shorten time required to manufacture the light string.

By using the winding bar 100 of the present disclosure, each procedure for manufacturing the light string is simultaneously performed to a plurality of light sources 300 in a batch manner, which is different from the manufacturing methods known in the art, i.e., performing wire stripping, light source welding, feeding glue for only one light source 300 at once, therefore, the method for manufacturing the light string of the present disclosure increases productivity significantly.

What is claimed is:

1. A winding bar for manufacturing a light string, comprising:

a bar-shaped body configured for manufacturing the light string; wherein:

the bar-shaped body includes a cross-section presenting a rectangular pattern or a polygonal pattern such that the bar-shaped body includes a plurality of sides having lateral surfaces, the bar-shaped body includes a work channel defined by the plurality of sides and extending along a longitudinal direction, the work channel communicates with two ends of the bar-shaped body, and a wire-shaping bar fixed in the work channel, the wire-shaping bar including a wire-shaping portion projecting outside the work channel and configured to directly contact wire of the light string wrapped about the exterior of the bar-shaped body and the wire-shaping bar.

2. The winding bar as claimed in claim 1, wherein the bar-shaped body includes guiding grooves on inner walls of the work channel and in parallel to the work channel; and the shaping bar further includes guided portions slidably assembled to the guiding grooves.

3. The winding bar as claimed in claim 1 further comprising a cooling passage in the bar-shaped body.

4. A method for manufacturing a light string by using a winding bar, comprising the steps of:

stripping off an insulation layer of a wire to expose conductors of a plurality of work areas of a wire;

winding the wire over the winding bar in a spiral manner, wherein the winding bar comprises a bar-shaped body, the bar-shaped body includes a cross-section presenting a rectangular pattern or a polygonal pattern, such that the bar-shaped body includes a plurality of sides having lateral surfaces, and the bar-shaped body includes a work channel defined by the plurality of sides and extending along a longitudinal direction, the work channel in communication with two ends of the bar-shaped body, and wherein each of the work areas of the wire is located over the work channel of the bar-shaped body;

soldering a plurality light sources onto the exposed conductors of the plurality of work areas; and feeding glue onto each of the light sources over the work channel in a batch manner, so as to cover each of the light sources with the glue.

5. The method as claimed in claim 4, further comprising a step for trimming the wire before the winding procedure.

6. The method as claimed in claim 4, wherein steps for soldering the plurality light sources onto the exposed conductors of the plurality work areas comprises:

printing solder paste onto the exposed conductors of the work areas in a batch manner;

temporarily attaching leads of the light sources onto exposed conductors of the work areas having the solder paste; and simultaneously heating the solder paste on the exposed conductors of the work areas to solder the plurality of light sources onto the exposed conductors of the work areas.

7. The method as claimed in claim 4, further comprising a step for extracting a piece of a light string having a predetermined length and cutting off the light string after the step for feeding glue onto each of the light sources over the work channel in a batch manner, so as to obtain the light string having the predetermined length and a predetermined number of light sources.

8. The method as claimed in claim 4, further comprising a step for forming a plurality of cut-off points of the wire over the bar-shaped body with a cutting tool after the step for feeding glue onto each of the light sources over the work channel in a batch manner, so as to have the light string over the bar-shaped body directly become a plurality of pieces of light strings having a predetermined length and a predetermined number of light sources.

9. The method as claimed in claim 4, wherein the step after the step of feeding glue onto each of the light sources over the work channel in a batch manner further comprises attaching a plurality of light caps onto the light sources in a batch manner using a cap holder.

* * * * *